US009764566B2

(12) United States Patent
Besson et al.

(10) Patent No.: US 9,764,566 B2
(45) Date of Patent: Sep. 19, 2017

(54) SUCTION BOX FOR A SYSTEM FOR CONVEYING FLAT MEDIA AND PRINTING MACHINE THUS EQUIPPED

(71) Applicant: BOBST MEX SA, Mex (CH)

(72) Inventors: Jean-Philippe Besson, Chavannes-près-Renens (CH); Pascal Marciano, Bussigny (CH)

(73) Assignee: BOBST MEX SA (CH)

( * ) Notice: Subject to any disclaimer, the term of this patent is extended or adjusted under 35 U.S.C. 154(b) by 0 days.

(21) Appl. No.: 15/326,254

(22) PCT Filed: Jul. 17, 2015

(86) PCT No.: PCT/EP2015/025050

§ 371 (c)(1),
(2) Date: Jan. 13, 2017

(87) PCT Pub. No.: WO2016/008597

PCT Pub. Date: Jan. 21, 2016

(65) Prior Publication Data

US 2017/0210146 A1 Jul. 27, 2017

(30) Foreign Application Priority Data

Jul. 18, 2014 (EP) ..... 14002499

(51) Int. Cl.
*B41J 2/01* (2006.01)
*B41J 11/00* (2006.01)
(Continued)

(52) U.S. Cl.
CPC ..... *B41J 11/0085* (2013.01); *B41J 2/16585* (2013.01); *B41J 11/007* (2013.01); *B41J 25/3082* (2013.01)

(58) Field of Classification Search
CPC .. B41J 11/0085; B41J 11/007; B41J 2/16585; B41J 25/3082
(Continued)

(56) References Cited

U.S. PATENT DOCUMENTS 6,471,430 B1 10/2002 Gaus et al.
8,104,888 B2 * 1/2012 Sugimoto ..... B41J 2/16585 347/101
(Continued)

FOREIGN PATENT DOCUMENTS

EP 1 847 397 A2 10/2007

OTHER PUBLICATIONS

International Search Report dated Sep. 28, 2015 issued in corresponding International patent application No. PCT/EP2015/025050.

*Primary Examiner* — An Do
(74) *Attorney, Agent, or Firm* — Ostrolenk Faber LLP

(57) ABSTRACT

A suction box, intended for a system for transporting flat media (4) includes at least one endless belt (6), formed with a plurality of through-holes, in a media-printing machine (1), equipped with at least one printing unit (2). The suction box has a face (16) past which the belt (6) passes. A suction device (17) generates a vacuum in the suction box. The face (16) of the suction box is formed with at least one zone at a first suction pressure (22, 23, 24), which is in communication with the suction device (17), so as to apply the vacuum through the holes in the belt (6) to the media being transported by the belt (6), and the face of the suction box has at least one zone at a second pressure (26, 27). The zone at a second pressure is situated in the region of the printing unit (2). The magnitude of the second pressure is greater than the magnitude of the first pressure.

15 Claims, 7 Drawing Sheets

(51) Int. Cl.
*B41J 2/165* (2006.01)
*B41J 25/308* (2006.01)

(58) Field of Classification Search
USPC ..... 347/101, 102, 104
See application file for complete search history.

(56) References Cited

U.S. PATENT DOCUMENTS 8,303,104 B2 * 11/2012 Miyagi ..... B41J 2/16585
346/139 R
8,317,315 B2 * 11/2012 Hoover ..... B41J 25/3082
347/101

* cited by examiner

SUCTION BOX FOR A SYSTEM FOR CONVEYING FLAT MEDIA AND PRINTING MACHINE THUS EQUIPPED

CROSS-REFERENCE TO RELATED APPLICATIONS

The present application is a 35 U.S.C. §§371 national phase conversion of PCT/EP2015/025050, filed Jul. 17, 2015, which claims priority of European Patent Application No. 14002499.3, filed Jul. 18, 2014, the contents of which are incorporated by reference herein. The PCT International Application was published in the French language.

BACKGROUND OF THE INVENTION

The present invention relates to a suction box intended for a system for conveying flat media. The invention relates to a system for conveying flat media comprising at least one suction box. The invention also relates to a printing machine for these media, equipped with a system for conveying flat media, and the system comprising at least one suction box.

A printing machine is used in the packaging industry for printing flat media such as sheets or a web of paper or cardboard. The machine comprises several stations in succession. A first infeed station, situated furthest upstream, inputs the medium in succession. The infeed station supplies several printing stations, in the form of one or more printing units placed one after the other. Each printing unit prints a specific color using an ink which has the equivalent coloration. A delivery station, which collects the medium which has been printed with an image, is provided at the end of the machine.

In the case of printing sheets of cardboard, particularly corrugated cardboard, the technology used most frequently is flexography using a flexo unit. Digital printing is also developing, with the use of printing units equipped with digital printing heads, for example of the inkjet-type. This printing technology enables a packaging manufacturer to change print jobs very quickly in order to print new sheets from a computer file representing the packaging.

The printing machine comprises one or more printing units, with the number of units depending on the number of colors desired. The medium is moved longitudinally from upstream to downstream from the infeed station, to the printing units and as far as the delivery station. In order to obtain a final high-quality image on the printed medium, it is in particular necessary that all the printed dots of different colors be placed exactly next to one another. It is also necessary that the printed dots not be deformed.

The printing quality obtained on the flat medium depends not only on the quality of the printing machines, the quality of the inks used and the quality of the media input, but also on the quality and accuracy of the media conveying system or systems used.

The medium is conveyed by a vacuum conveying system using a belt, flat straps, or steel rolls driven in order to move the medium longitudinally from one printing unit to another, upstream to downstream, from the infeed station to the delivery station. In order to obtain optimal print quality, one of the fundamental principles is that the medium is conveyed at a speed which is as uniform as possible. Another principle is that the medium must be held as firmly as possible and must be guided perfectly by the conveying system so that there is no deviation during the printing by the printing unit or units or between the printing unit or units.

PRIOR ART

U.S. Pat. No. 6,471,430 describes a printing machine for media in the form of sheets of paper or cardboard, comprising a conveying system. For the printing, the sheets are taken from a sheet feeder and conveyed on a first endless conveying belt. The sheets are held in place by a suction system while they are being conveyed and the sheets pass under first printing units and under a first ink dryer downstream from the first printing units. The sheets are then turned over and are conveyed by a second conveying belt under second printing units and under a second ink dryer and are then collected in an output station.

The conveying belts include a series of through holes which enable air to be sucked through the belts and the holding effect obtained allows the sheets to be conveyed inside the machine. Suction boxes are placed beneath the belts in order to generate the vacuum.

However, the use of a suction system for applying a vacuum beneath the conveying belt and thereby holding the sheets to be printed flat has certain disadvantages. The vacuum created has an effect on the medium and has an influence on the depositing of the ink itself and thus on the print quality.

SUMMARY OF THE INVENTION

A main object of the present invention is to provide a suction box intended for a system for conveying flat media in a printing machine for flat media. A second object is to provide a suction box for conveying media which are to be printed, which ensures that these media are held satisfactorily on the conveying belt of the conveying system. A third object is to develop a suction box which has a negligible influence on the printing process so that the process preserves the required accuracy. A fourth object is to adapt a conveying system with an endless belt for printing flat media comprising at least one suction box. A fifth object is to overcome the technical problems mentioned for the boxes and the conveying systems from the prior art. Yet another object is to improve further the print quality for a printing machine for flat media which is equipped with at least one printing unit.

According to an aspect of the present invention, a suction box is intended for a system for conveying flat media with at least one endless conveying belt provided with a set of through holes, in a printing machine for flat media which is equipped with at least one printing unit.

A suction box defines a region of partial vacuum which sucks air into the suction box. The resultant reduced level of pressure in the suction box is below the ambient pressure. The reduced pressure draws a conveying belt having through holes and the flat media or sheets to be printed, which are being conveyed on the belt toward the suction box. The suction pressure in the suction box is measured as being lower than the ambient pressure, that is, the first suction pressure is lower than the second pressure, for example, ambient pressure which is higher.

The suction box comprises:

- a face at and past which the endless belt passes, and
- a suction device capable of generating a vacuum in the suction box under the belt.

The suction box has a face formed with:

at least one zone at a first suction pressure. The zone at a first suction pressure communicates with the suction device, for applying the vacuum generated by the suction device at the first suction pressure in the suction box and through the through holes in the endless belt to the flat media conveyed by the endless belt, and at least one zone at a second suction pressure. The zone at a second pressure is situated in the region of the printing unit, and the second pressure is greater than the the first pressure. In a preferred, but not restricting, embodiment, the zone at a second pressure is at the ambient pressure, with no connection to the suction box or the suction device so that the decreased pressure in the zone at a second pressure actually has a pressure that is higher than the zone at a first suction pressure. In an alternate embodiment, the zone at a second pressure is not at ambient pressure but may be at a slightly lower suction pressure but still greater than the suction pressure in the at least one zone at a first suction pressure.

The suction generated by the suction device is interrupted in the region of the printing unit in order not to disrupt the printing. This suction is active in the region of the endless belt before and after the belt passes the printing unit. The zone or zones at a second pressure do not communicate with the suction device. The flat medium which is to be printed by the printing unit thus continues to be carried along perfectly by the belt as far as the point where it arrives at the printing unit and after the point where the flat medium leaves the printing unit. This maintains a high and optimum suction in the region of the suction zone or zones in order to preserve the flatness of the flat media, the lack of any movement of the flat media with respect to the conveying belt, and hence the accuracy of the conveying.

A flat medium is defined, by non-limiting example, as being made from a material in the form of a sheet, a board, or a continuous strip such as paper, flat cardboard, corrugated cardboard, laminated corrugated cardboard, flexible plastic, for example polyethylene (PE), polyethylene tetraphthalate (PET), bi-oriented polypropylene (BOPP), or other polymers, or still other materials. The flat medium is defined, by non-limiting example, as being a sheet intended to be formed into a blank and blank into a packaging box.

The longitudinal direction is defined with reference to the trajectory of the flat medium within the printing machine, along its central longitudinal axis. The upstream and downstream directions are defined with reference to the direction of movement in the trajectory of the medium, in the longitudinal direction of the overall printing machine.

In another aspect of the invention, a system for conveying flat media with at least one endless belt provided with a set of through holes, in a printing machine for the media which is equipped with at least one printing unit, comprises at least one suction box having one or more of the technical features described below.

In another aspect of the invention, a printing machine for flat media, which is equipped with at least one printing unit, comprises a system for conveying the media, comprising at least one suction box having one or more of the technical features described below.

According to yet another aspect of the invention, a printing machine for flat media, which is equipped with at least one printing unit, comprises a system for conveying the media having one or more of the technical features described below.

BRIEF DESCRIPTION OF THE DRAWINGS

The invention will be readily understood and its various advantages and different features will become more apparent from the following description of the non-limiting exemplary embodiment, with reference to the attached schematic drawings.

DESCRIPTION OF PREFERRED EMBODIMENTS

Figure 1:
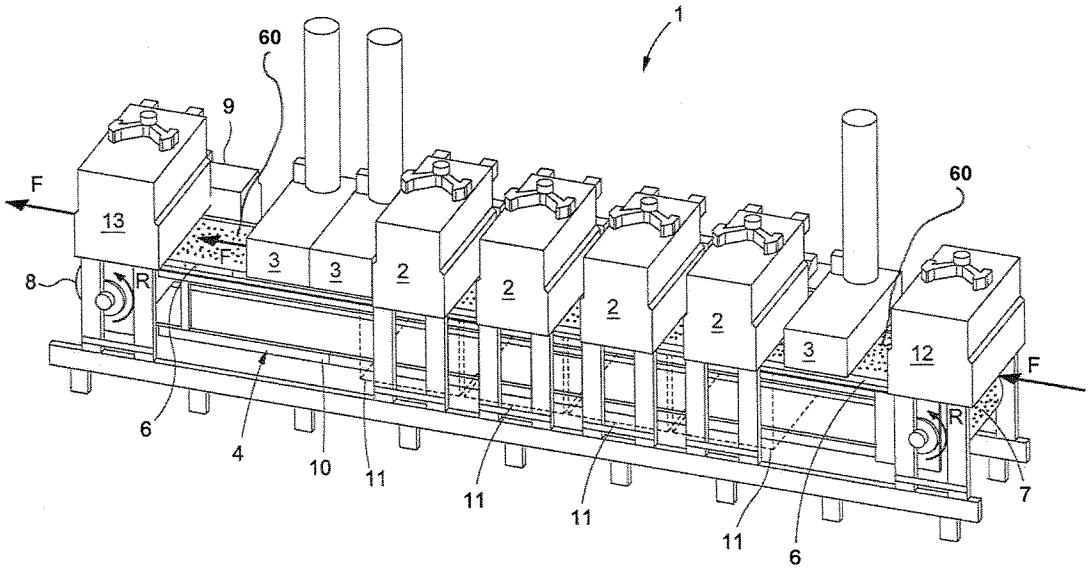
FIG. 1 shows a perspective view of a printing machine, comprising a conveying system and suction boxes according to the invention.
Figure 2:
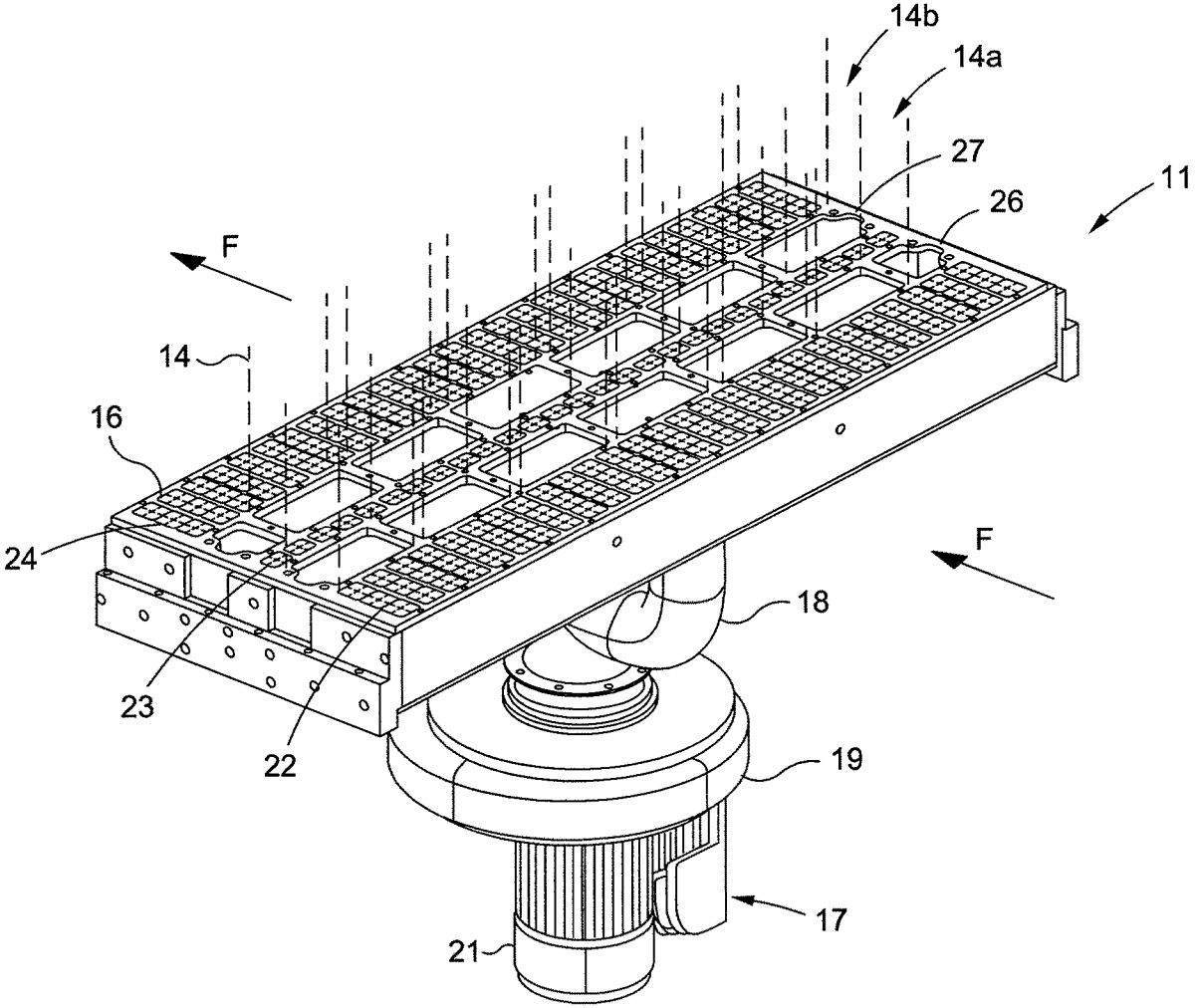
FIGS. 2 and 3 show a perspective plan view of a suction box, according to a first and a second embodiment of the invention, respectively.
Figure 3:
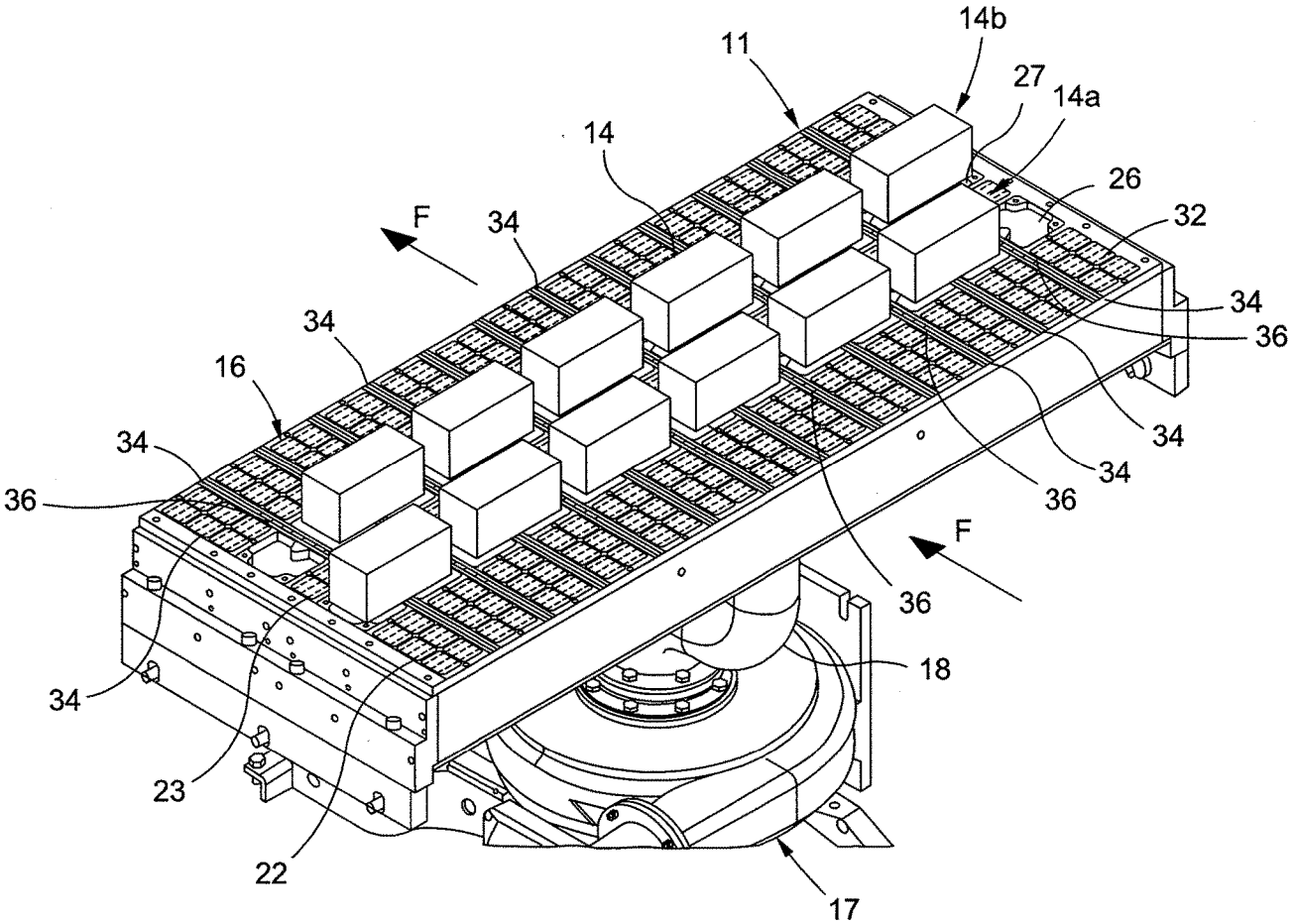
Figure 5:
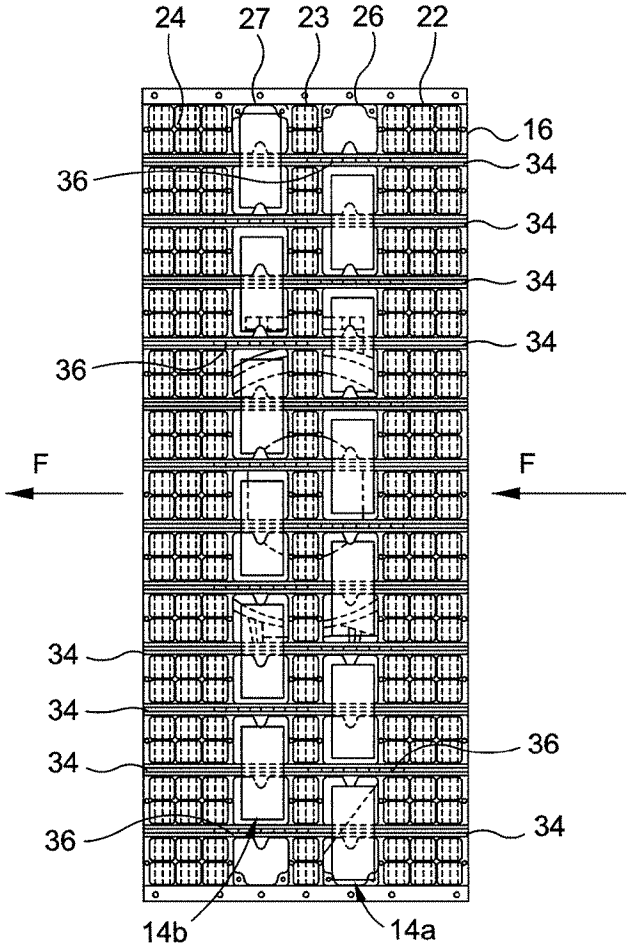
FIGS. 4 and 5 show a plan view of the box in FIG. 2 and the box in FIG. 3, respectively.
Figure 4:
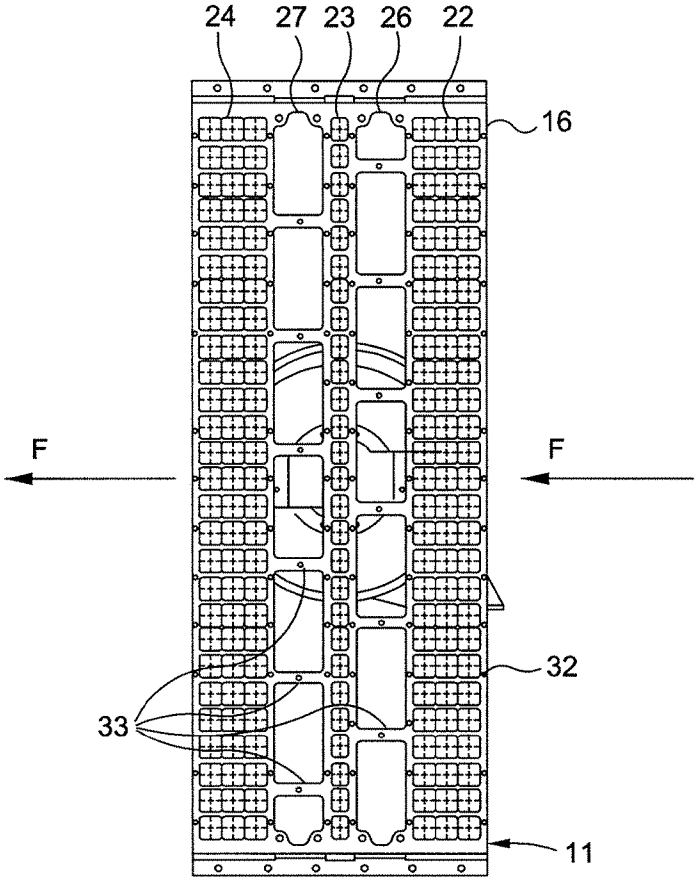
Figure 6:
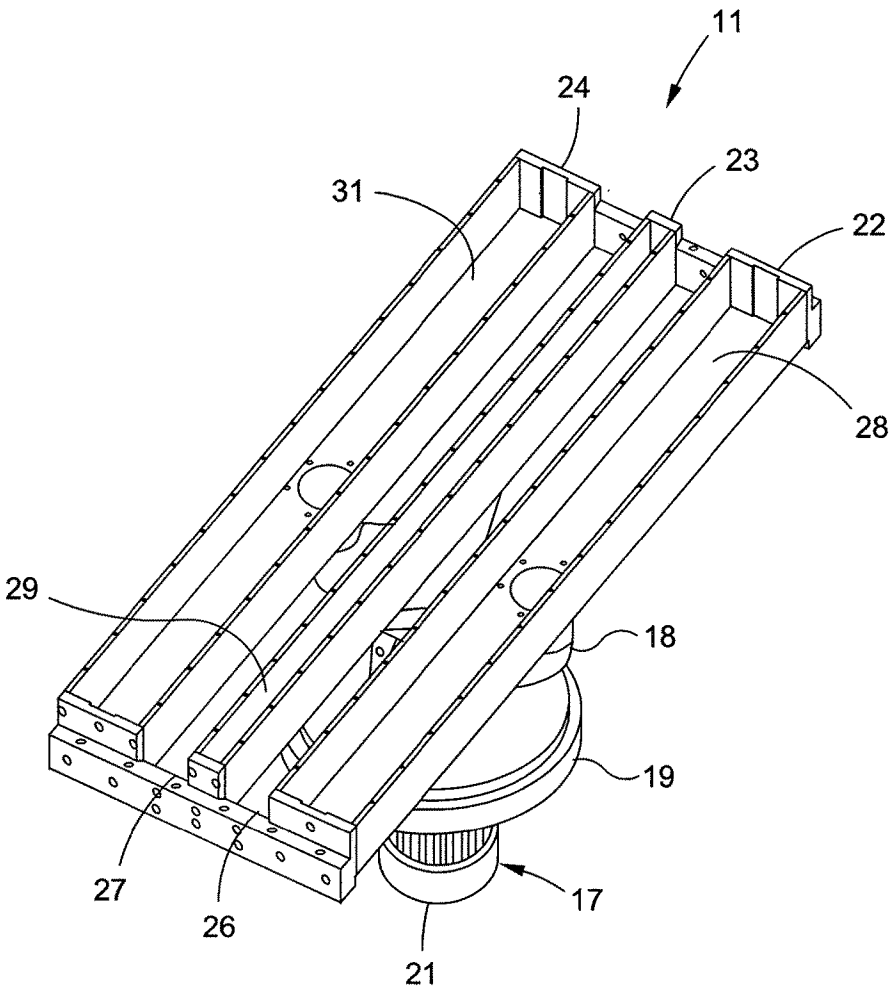
FIG. 6 shows a perspective plan view of the box in FIG. 2, with no plate.
Figure 7:
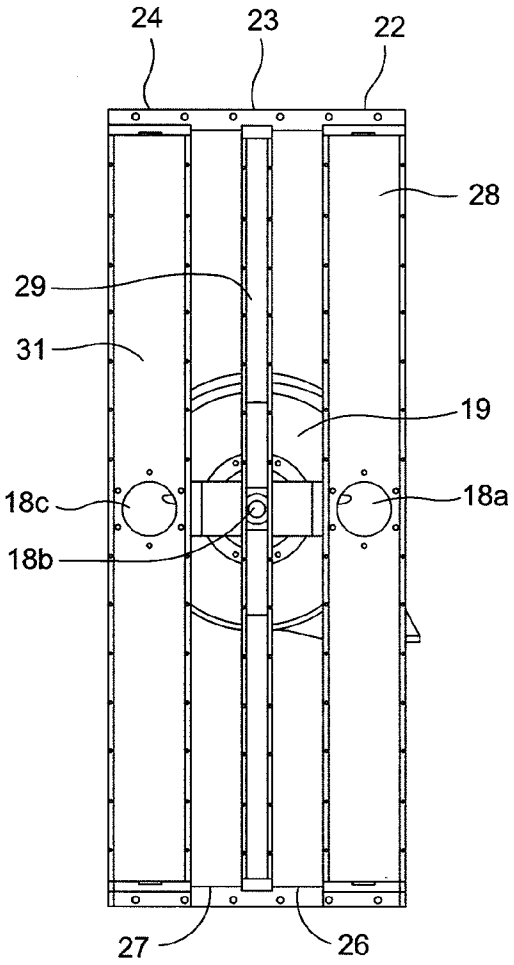
FIG. 7 shows a plan view of the box in FIG. 2, with no plate.
Figure 8:
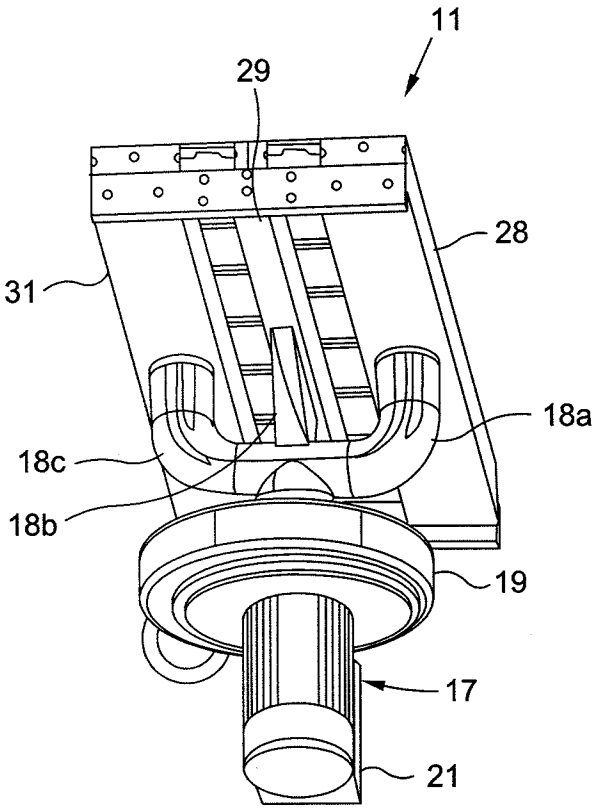
FIG. 8 shows a perspective view of the underside of the box in FIG. 2.

As illustrated in FIG. 1, a printing machine 1 is used for printing media in the form of plate-like elements, for example sheets of corrugated cardboard. In the main exemplary embodiment, the machine 1 is a digital printing machine which includes, for example, some constituent parts described in U.S. Pat. No. 6,471,430 incorporated herein by reference. The machine 1 comprises in particular a set of four printing units 2 arranged in a line, one after the other. Water-based black, cyan, magenta, and yellow inks are printed in succession by the printing units 2 onto the sheets.

The sheets are input (arrows F in FIGS. 1-5) by a feed station (not shown), mounted upstream from the printing machine 1 (not shown). The sheets are then gripped, are conveyed, circulate in longitudinal direction F, and are output in direction F after they are printed at a delivery station (not shown), mounted downstream from the printing machine 1. Two dryers 3, with steam discharge tubes, are placed downstream from the printing units 2.

The sheets which are to be printed are conveyed from upstream to downstream by a conveying system 4. The conveying system 4 comprises at least one belt, in this case a single endless metal belt 6 (FIG. 1) which is mounted between a first upstream roller 7 and a second downstream roller 8. Passage of the endless belt 6 over rollers 7 and 8 defines an upper or top run of the belt and a lower or bottom run of the belt. The endless belt 6 is provided with a set of through holes 60 in FIG. 1. At least one of the two rollers 7 and 8 is driven in rotation (arrow R in FIG. 1) by means of a motor 9, which drives the belt 6. The rollers 7 and 8 and the belt 6 are mounted on a frame 10.

The sheets remain applied flat to the top run of the belt 6 by virtue of suction boxes, which are also called vacuum boxes 11, located below the top run of the belt 6 and the sheets are passed by the top run of the belt 6 beneath the printing units 2 and dryers 3. Only the vacuum boxes 11 beneath the printing units 2 are shown in dashed lines in FIG. 1.

In order to promote the adhesion and stability of the inks which will be deposited by printing on the cardboard sheets which are to be printed, the printing machine 1 preferably comprises an upstream coating unit 12, arranged upstream from the first printing unit 2, and just after the feed station. The upstream coating unit 12 is placed at a right angle to the upstream roller 7. In order to dry the coating, a dryer 3 may be interposed between the upstream coating unit 12 and the first printing unit 2.

In order to promote stability and protection of the inks which are deposited by printing on the cardboard sheets which have been printed, the printing machine 1 preferably comprises a downstream coating unit 13. A downstream coating unit 13 is arranged downstream from the last printing unit 2 and downstream from the dryers 3, just before the delivery station. The downstream coating unit 13 is placed at a right angle to the downstream roller 8.

In the printing machine 1, each of the printing units 2 is equipped with at least one contactless digital print head 14, for example of the inkjet type. For example, a set of twelve heads 14 (shown in dashed lines in FIG. 2) is provided. Each head 14 is oriented downward. The upper face of the sheets conveyed by the top run of the belt 6 are then being printed.

The printing unit 2 and hence the machine 1 preferably comprise a first upstream series or row 14*a* of digital print heads 14 arranged transversely with respect to the belt 6. The printing unit 2 and hence the machine 1 preferably comprise a second downstream series or row 14*b* of digital print heads 14 arranged transversely with respect to the belt 6. In order to cover the whole width without interruption, the heads 14 of the first series 14*a* are offset transversely to direction F with respect to the heads 14 of the second series 14*b*.

Four suction boxes 11 are mounted on the frame 10 under the top run of the belt 6. A box 11 is situated between the upper part of the belt run of the belt 6 which conveys the sheets and the lower part of the belt run of the belt 6 which makes the return travel. Each suction box 11 comprises a substantially flat upper face 16 oriented toward the lower face of the top run of the belt 6. The sheets are applied flat against the top face of the top run of the belt 6. The belt 6 passes at the upper face 16 of the suction box.

Each suction box 11 comprises a suction device 17 capable of generating a vacuum in the suction box. The suction device 17 comprises at least one suction duct or tube 18 and a suction system 19, in the form of a motor 21.

During printing with the print heads 14, it is important that micro-droplets of the inkjet emitted by the heads 14 maintain an optimum trajectory and shape in order to preserve the print quality desired by the operator. In order to ensure that these micro-droplets do not deviate from their trajectory and do not accelerate before they reach the sheet. The following is provided.

According to a first embodiment of the invention (see FIGS. 2 and 4), the upper face 16 of the suction box is firstly formed with at least one zone at a first suction pressure, in this case with three such suction zones 22, 23 and 24 in sequence in direction F. The three suction zones 22, 23 and 24 communicate with the suction device 17 in order to apply vacuum through the holes 60 in the belt 6 to the media or sheets conveyed by the belt 6. For each suction box 11, the upper face 16 of the suction box is formed with an upstream suction zone 22, a central suction zone 23, and a downstream suction zone 24 with reference to the direction F of conveyance of the sheets.

According to the first embodiment of the invention, the upper face 16 of the suction box is then formed with at least one zone at a second pressure. The second pressure is different from and greater than the first suction pressure. In the example shown in FIGS. 2 and 4, the upper face 16 has two zones in sequence in direction F at ambient pressure 26 and 27. Zone 26 is between zones 22 and 23. Zone 27 is between zones 23 and 24, whereby the different pressure zones alternate in direction F. For each box 11, the face 16 is formed with a first upstream zone at ambient pressure 26 and a second downstream zone at ambient pressure 27.

In the box 11, the zone at ambient pressure 26 and 27 is preferably surrounded by a suction zone 22, 23 and 24. In more detail, the two zones at ambient pressure 26 and 27 favorably alternate with the three suction zones 22, 23 and 24, each zone at ambient pressure 26 and 27 is surrounded by a suction zone 22, 23 and 24. The two zones at ambient pressure 26 and 27 are situated in the region of the printing unit 2, and more particularly under the printing unit 2. Preferably, and more precisely, the zones at ambient pressure 26 and 27 are situated at a right angle to the print heads 14. The zones at ambient pressure 26 and 27 open into the ambient.

The suction zones 22, 23 and 24 are situated so that they are offset longitudinally from the print heads 14. The zones 22, 23, 24, 26 and 27 are oriented transversely with respect to the belt 6. The first zone at ambient pressure 26 is situated at a right angle to the first series of print heads 14*a*, and the second zone at ambient pressure 27 is situated at a right angle to the second series of heads 14*b*.

As soon as the leading end region of the sheet has been printed by the first series of heads 14*a*, that end region is held in place on the belt 6 as it is picked up by the central suction zone 23, and the leading end then passes under the second series of print heads 14*b* to be printed, and is then again held in place as it is picked up by the downstream suction zone 24.

Each suction zone 22, 23 and 24 is associated with an underlying suction compartment 28, 29 and 31, respectively, which forms part of the suction box 11 and forms part of the suction device 17 (see FIGS. 4 to 7). The upstream compartment 28 enables generating the vacuum in the region of the upstream suction zone 22. The central compartment 29 enables generating the vacuum in the region of the central suction zone 23. The downstream compartment 31 enables generating the vacuum in the region of the downstream suction zone 24. Each compartment 28, 29 and 31 forms a substantially parallelepipdal transverse volume. The compartments 28, 29 and 31 are separated from one another, which enables delimiting the zones at ambient pressure 26 and 27.

Each compartment 28, 29 and 31 communicates with a suction duct 18*a*, 18*b* and 18*c* (see FIG. 7) which opens out in the center of each of the compartments 28, 29 and 31. The suction ducts 18*a*, 18*b* and 18*c* converge in the suction system 19 and form part of the suction device 17.

Each suction zone 22, 23 and 24 is favorably equipped with a plate pierced with orifices 32. The plate and its orifices enable making the suction uniform in the region of the suction zones 22, 23 and 24. A single upper plate pierced with orifices 32 can cover the whole face 16. The belt 6 passes directly over the plate 32. The plate 32 comprises longitudinal rods 33 which allow the upstream suction zone 22 to be separated from and connected to the central suction zone 23, and the central suction zone 23 to be separated from and connected to the downstream suction zone 24. The length of the rods 33 defines the length of the zones at ambient pressure 26 and 27.

In a second embodiment of the invention (see FIGS. 3 and 5), the upper face 16 of the suction box is initially formed with at least one zone at a first suction pressure, and in this case three suction zones, an upstream one 22, a central one 23 and a downstream one 24, which are substantially similar to one another and function in a manner which is substantially similar to the first embodiment.

The upper face 16 is formed with at least one zone at a second pressure. This second pressure is different from and greater than the first suction pressure. By way of example shown in FIGS. 3 and 5, the upper face 16 has two zones at a suction pressure which is different from ambient pressure and less than ambient pressure 26 and 27.

Each suction zone 22, 23 and 24 is favorably equipped with a plate pierced with orifices 32. The plate and its orifices 32 cause the suction to be uniform in the suction zones 22, 23 and 24. A single upper plate pierced with orifices 32 can cover the whole upper face 16. The belt 6 passes directly over the plate 32. In the second embodiment (FIGS. 3 and 5), the plate 32 comprises ribs, pads or runners 34 which are arranged longitudinally and allow the belt 6 to be held. The belt 6 circulates by sliding over the upper edge of these pads 34.

The sheets which are being printed must be prevented from moving up and down and undulating in the region of the print heads 14, depending on the suction pressure exerted on them. It is thus interesting to reduce the pressure difference between the first suction pressure and the second pressure while retaining the first suction pressure in order to keep the first suction pressure lower than the second pressure.

In order to do this, aligned orifices 36 are arranged in the region of the ribs 34 and make it possible to connect the zones at a first suction pressure 22, 23 and 24 to the zones at a second pressure 26 and 27. The orifices 36 situated upstream form an interconnection between the upstream suction zone 22, the first upstream zone at a second pressure 26, and the central suction zone 23. The orifices 36 situated downstream form an interconnection between the central suction zone 23, the second downstream zone at a second pressure 27, and the downstream suction zone 24.

The number of print heads 14 and series of heads 14*a* and 14*b* may vary. The same applies to the number of suction zones 22, 23 and 24 and zones at ambient pressure 26 and 27. A common suction system may be provided as suction means 17 for multiple suction boxes 11.

The present invention is not limited to the embodiments described and illustrated. Numerous modifications may be made without in so doing going beyond the scope of the claims.

The invention claimed is:

1. A suction box configured for use in a system for conveying flat media, the system having at least one endless belt configured and operable for conveying the media, the belt being provided with a plurality of through holes, the suction box and the belt being configured for use in a printing machine for printing on media, the printing machine comprising at least one printing unit which includes a print head;

the suction box comprising:

a face which the belt passes the box; and a suction device located and configured for generating a vacuum in the suction box;

the face of the suction box including:

at least one first zone of the suction box is at a first suction pressure due to communicating with the suction device, the first zone being configured for applying a vacuum through the through holes in the belt, the first zone being away from the print head and applying vacuum to the media conveyed by the belt wherein those media are then away from the print head; and at least one second zone of the suction box is at a second pressure and situated in a region of the printing unit, the second zone being at the print head, wherein, the second pressure is greater than the first pressure.

2. A box according to claim 1, further comprising the at least one second zone at a second pressure is oriented at a right angle to at least one of the digital print heads with which the printing unit is equipped, and the zone at a first suction pressure is situated longitudinally offset from the print head at an angle which is different from the right angle to the at least one of the print heads.

3. A box according to claim 1, further comprising two of the first zones at a first suction pressure, and one of the first zones at a first suction pressure surrounding the second zone at a second pressure.

4. A box according to claim 1, in which the zones are oriented transversely to a direction of the belt conveying and the media.

5. A box according to claim 1, further comprising a stationary plate pierced with orifices, the plate being located at the first zone at a first suction pressure.

6. A box according to claim 1, further comprising a respective suction compartment associated with each first zone at a first suction pressure.

7. A box according to claim 1, further comprising the suction device comprises at least one suction duct and one suction system supplying vacuum to the suction device.

8. A box according to claim 7, wherein each compartment communicates with a respective one of the suction ducts.

9. A system for conveying flat media comprising:

at least one endless belt driven to convey the media for being printed, the belt provided with a plurality of through holes, the belt being located in a printing machine for printing media and wherein the printing machine includes at least one printing unit, and the system comprising at least one suction box according to claim 1.

10. A system according to claim 9, further comprising first and second rollers between which the endless belt is mounted to be driven in rotation by at least one drive motor configured for driving the belt in the direction of conveying.

11. A printing machine for flat media comprising at least one printing unit, and comprising a system for conveying the media, according to claim 9.

12. A machine according to claim 11, wherein each printing unit is associated with a respective suction box.

13. A machine according to claim 11, wherein each printing unit is equipped with at least one digital print head for printing the flat media conveyed past the print head.

14. A machine according to claim 11, further comprising:

a first series of digital print heads arranged transversely of a direction of conveying of the media, a first sector from the at least one second zone at a second pressure situated at a right angle to the first series;

a second series of digital print heads arranged transversely of a direction of conveying the media, and a second sector from the at least one second zone at a second pressure being situated at a right angle to the second series.

15. A printing machine for flat media which is equipped with at least one printing unit, and the machine comprising a system for conveying the media through the printing unit, and comprising at least one suction box according to claim 1.

* * * * *